United States Patent [19]

Credelle

[11] 4,335,332

[45] Jun. 15, 1982

[54] FOCUS MESH STRUCTURE AND BIASING TECHNIQUE FOR FLAT PANEL DISPLAY DEVICES

[75] Inventor: Thomas L. Credelle, East Windsor, N.J.

[73] Assignee: RCA Corporation, New York, N.Y.

[21] Appl. No.: 230,362

[22] Filed: Jan. 30, 1981

[51] Int. Cl.[3] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 2,858,464 | 10/1958 | Roberts | 313/422 |
| 2,879,446 | 3/1959 | Aiken | 315/366 |
| 3,005,127 | 10/1961 | Aiken | 315/366 |
| 4,031,427 | 6/1977 | Stanley | 313/422 |
| 4,227,117 | 10/1980 | Watanabe et al. | 313/422 |
| 4,234,815 | 11/1980 | Credelle | 313/422 |
| 4,259,612 | 3/1981 | Christiano et al. | 315/366 |

*Primary Examiner*—Theodore M. Blum

*Attorney, Agent, or Firm*—Eugene M. Whitacre; Dennis H. Irlbeck; Lester L. Hallacher

[57] ABSTRACT

A flat panel display device includes means for focusing electron beams traveling from a beam guide structure towards a display screen. The means for focusing includes focus meshes which are parallel to and spaced from one another and from the electron beam propagation means.

7 Claims, 4 Drawing Figures

FOCUS MESH STRUCTURE AND BIASING TECHNIQUE FOR FLAT PANEL DISPLAY DEVICES

BACKGROUND OF THE INVENTION

This invention relates generally to flat panel display devices and particularly to a focus mesh structure and biasing technique for such devices.

U.S. Reissue Pat. No. Re. 30,195 to C. H. Anderson et al., discloses a flat panel display device in which a backplate and a faceplate are spaced in parallel planes. A plurality of vanes extend between the backplate and faceplate to divide the envelope into a plurality of channels and to support the faceplate and backplate against atmospheric pressure after the envelope is evacuated. Arranged in each of the channels is a pair of spaced apart parallel beam guide meshes which extend longitudinally along the channels and transversely across the channels. The beam guide meshes serve as guides along which electron beams are propagated the lengths of the channels.

The inside surface of the faceplate is provided with a phosphor screen which luminesces when struck by electrons. A plurality of extraction electrodes are arranged along the backplate and are used to eject the electron beams from between the beam guide meshes to direct the electron beams toward the phosphor screen. Deflection electrodes are provided on the sides of the support vanes and are electrically energized to cause the electrons to transversely scan across the channels. Accordingly, each of the channels contributes a portion of the total visual display of the device.

U.S. Pat. No. 4,137,478 to T. L. Credelle, discloses a flat panel display device of the element scale type which utilizes a separate guide and electron beam for each color element in every line of the visual display. This device therefore does not employ deflection electrodes. The electron beams are directed toward the desired line by appropriately biasing one of many focusing means which extend across the device. The number of focusing wires is at least equal to the number of lines in the display.

The inventions described in the above-referenced patents are quite satisfactory for the purpose intended. For the purpose of their disclosure, U.S. Pat. Nos. Re. 30,195 and 4,137,478 are hereby incorporated by reference. However, a display device intended for use with standard NTSC television signals must be capable of scanning approximately 525 lines. Accordingly, the meshes of the Anderson device must contain a number of rows of apertures which equals at least one half the number of lines in the display. Similarly, the number of wires in the Credelle device must at least equal the number of lines in the display. The dimensions, and accordingly the tolerances in both devices, therefore, are very tight making the devices very difficult to manufacture.

The instant invention overcomes these difficulties by the provision of a focus mesh structure and biasing techniques which permit greatly increased dimensions and substantially relaxed tolerances.

SUMMARY OF THE INVENTION

A flat panel display device includes means for focusing electron beams traveling from a beam guide structure toward a display screen. The means for focusing includes a plurality of focus meshes which are parallel to one another and to the beam guide structure.

DETAILED DESCRIPTION OF THE PREFERRED EMBODIMENT

Figure 1:
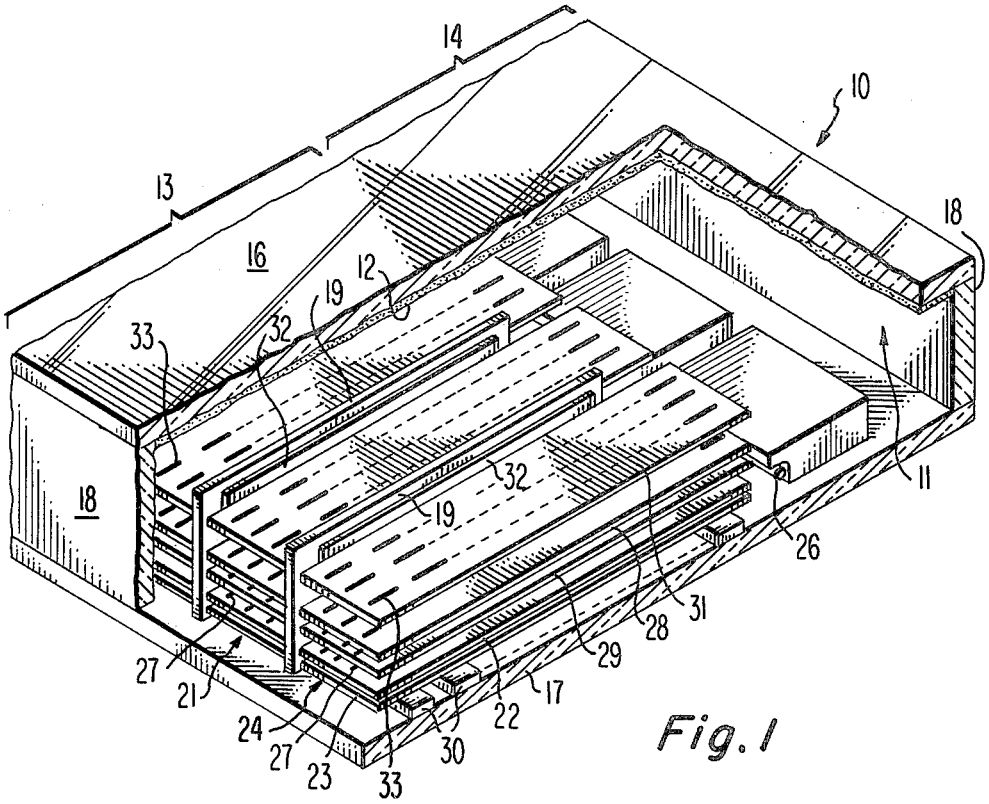
FIG. 1 is a simplified perspective view partially broken away showing the major components of a flat panel display device incorporating the preferred embodiment.

FIG. 1 shows a flat panel display device 10 which incorporates the preferred embodiment. The display device 10 includes an evacuated envelope 11 having a display section 13 and an electron gun section 14. The envelope 11 includes a faceplate 16 and a backplate 17 held in a spaced parallel relationship by sidewalls 18. A display screen 12 is positioned along the faceplate 16 and gives a visual output when struck by electrons.

A plurality of spaced parallel support vanes 19 are arranged between the faceplate 16 and the backplate 17. The support vanes 19 provide the desired internal support against external atmospheric pressure and divide the envelope 11 into a plurality of channels 21. Each of the channels 21 enclose a pair of spaced parallel beam guide meshes 22 and 23 extending transversely across the channels and longitudinally along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21 and in rows transversely across the channels. Two focus meshes 28 and 29 are spaced above the upper guide mesh 22 in a parallel relationship therewith. A plurality of extraction electrodes 30 is arranged along the backplate 17 to extend transversely across the channels 21 the full width of the display device 10. The extraction electrodes 30 are arranged directly beneath the rows of apertures 27 in the guide meshes 22 and 23. Appropriate biasing voltages are applied to the focus meshes 28 and 29 and the extraction electrodes 30 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 33 which also are aligned in columns longitudinally of the channels and in rows transversely of the channels. Scanning electrodes 32 are arranged on both sides of the support vanes 19 so that each vane supports a scanning electrode for two adjacent channels.

In operation the electron beams propagate in the spaces 24 between the guide meshes 22 and 23 until the production of one line of the visual display requires the beams to be directed toward the screen 12. Extraction of the electron beams from the spaces between the guide meshes is effected by applying a negative voltage to one of the extraction electrodes 30. The negative voltage causes the electron beams to pass through the apertures 27 in the guide mesh 22, the apertures 34 and 35 in the focus meshes 28 and 29, respectively, and the apertures 33 in the acceleration mesh 31. The extracted electron beams are transversely scanned across the channels 21 by the application of varying voltages, such as triangular waveforms, to the scanning electrodes 32 on the sides of the support vanes 19. Every channel therefore is transversely scanned between the two support vanes 19 so that each channel contributes a portion of each line of the visual display on the faceplate 16.

Figure 2:
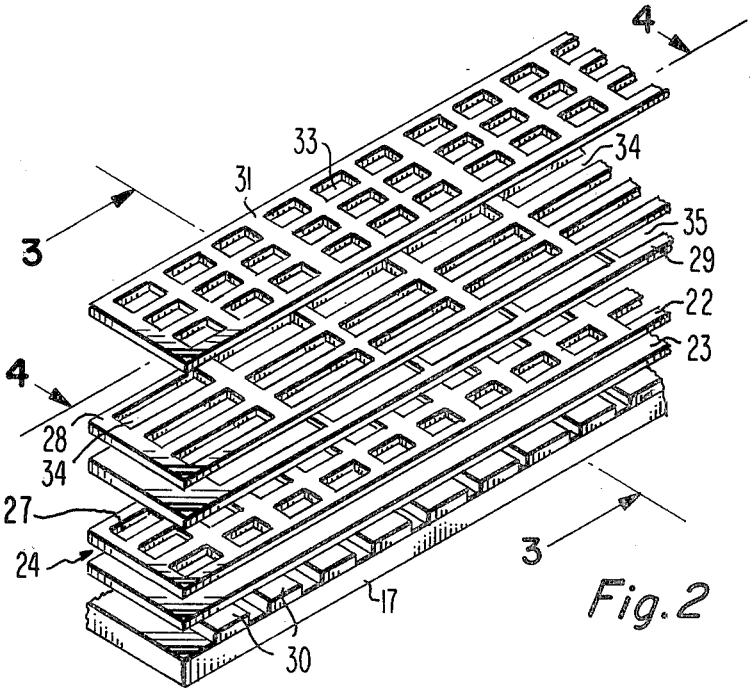
FIG. 2 is a perspective view partially broken away of a preferred embodiment of the instant invention.

FIG. 2 is a perspective view, partially broken away of a preferred embodiment which permits the generation of four visual lines for each transverse row of apertures 27 in the guide meshes 22 and 23. Two focus meshes 28 and 29 are arranged in a spaced parallel relationship with respect to each other and with respect to the guide meshes 22 and 23. The focus mesh 28 includes a plurality of apertures 34 which are arranged in columns longitudinally along the mesh and in rows transversely of the mesh in the same manner as the apertures 27 in the guide meshes 22 and 23. Similarly, the focus mesh 29 contains a plurality of apertures 35 which also are arranged in longitudinal columns and transverse rows. The spacing between the focus meshes 28 and 29 is quite small, for example, 20 mils and is substantially less than the distance between the meshes 29 and 22 or the mesh 28 and 31.

Figure 3:
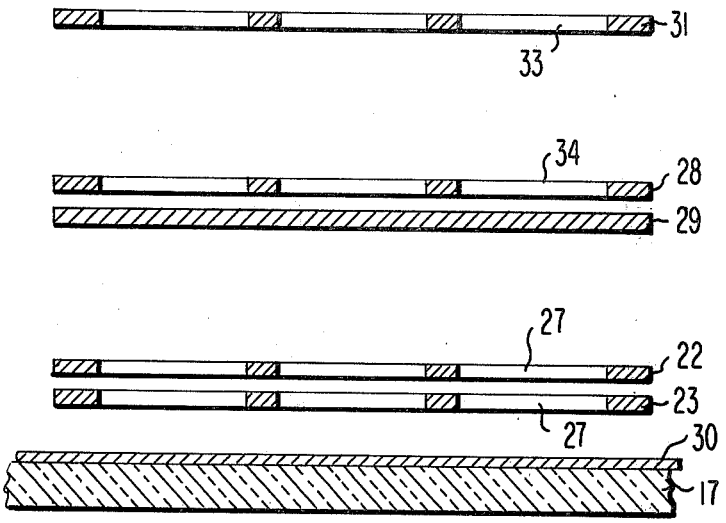
FIG. 3 is a cross section taken along line 3—3 of FIG. 2.

FIG. 3 is a transverse cross section taken along line 3—3 of FIG. 2 showing three apertures in each transverse row of apertures in each mesh. The section through the mesh 29 passes through the portion of the mesh between apertures. Each of the meshes therefore includes three columns of apertures and each column is in an electron beam guide. Such structure is used when a color visual output is to be produced utilizing three separate electron beams. However, a single electron beam can be used to generate all three colors of the visual display or a black and white visual display. In these instances, a single column of apertures is included in each of the meshes 22, 23, 28, 29 and 31. Thus, referring to FIG. 3, only the middle column of apertures would be used in the five meshes.

Figure 4:
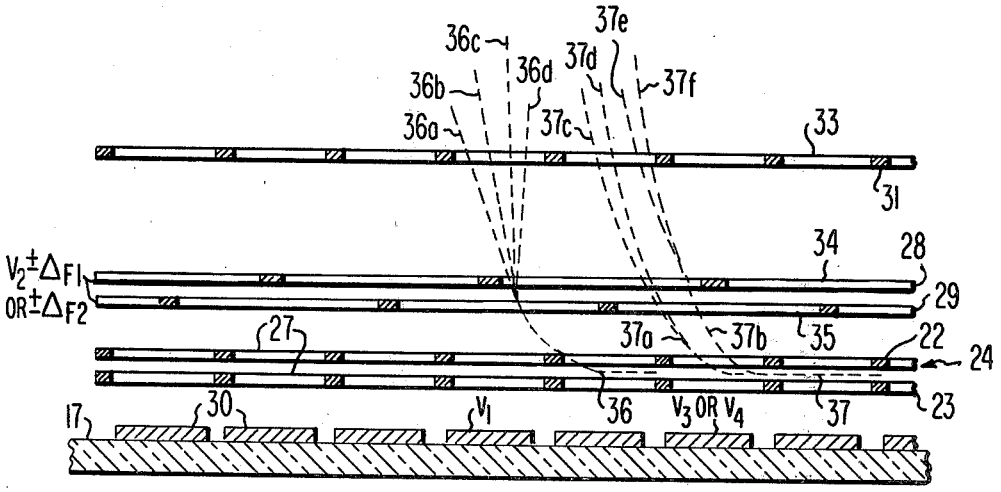
FIG. 4 is a cross section taken along line 4—4 of FIG. 2.

FIG. 4 is a longitudinal cross section taken along line 4—4 of FIG. 2 and is used in understanding how the focus means comprising the two focus meshes 28 and 29 can be used to generate four lines of the visual display for each of the transverse rows of apertures in the beam guides and focus meshes. Thus, only 131 transverse rows of apertures would be required for a 525 line display. The focus meshes 28 and 29 are closely spaced and parallel to one another and to the guide meshes 22 and 23. The apertures 34 in the mesh 28 are longitudinally offset from the apertures 35 in the mesh 29. Preferably, the offset is equal to one half of the longitudinal dimension of the apertures 34 and 35. The apertures 34 and 35 are dimensioned equally in both directions and longitudinally are dimensioned to span two of the apertures 27 in the guide mesh 22. The extraction electrodes 30 are aligned with the rows of apertures 27 in the meshes 22 and 23 and thus are equal in number to the rows of apertures.

FIG. 4 shows a structure which can be biased in several ways to generate four display lines for each of the extraction electrodes 30. If desired, different numbers of lines can be generated by using other voltages, focus meshes or extraction electrodes. In one biasing technique, an electron beam 36 propagates in the space 24 between the guide meshes 22 and 23. The electron beam 36 is repelled from the space 24 by the application of a negative voltage $V_1$ to one of the extraction electrodes 30. The electron travels to the focus meshes 28 and 29 and then can be deflected along any one of the four paths **36*a*, 36*b*, 36*c* or 36*d* depending upon the voltages which are applied to the focus meshes 28 and 29. The focus meshes 28 and 29 are biased with a nominal voltage $V_2$. The nominal voltage $V_2$ is increased in one mesh by either $\Delta V_{f1}$ or $\Delta V_{f2}$ and is decreased on the other mesh by the same increment, e.g., $-\Delta V_{f1}$ or $-\Delta_{Vf2}$ ($\Delta V_{f1} \neq \Delta V_{f2}$). Four voltage combinations therefore are possible and result in the electron beam following the four paths 36*a*, 36*b*, 36*c* and 36*d*. For example, when the mesh 28 voltage is $V_2+\Delta V_{f1}$, the mesh 29 voltage is $V_2-\Delta V_{f1}$ and the path 36*a* is followed. However, by simply reversing these two voltages, the path 36*d* is followed. The same type of selection using $\Delta V_{f2}$ results in the paths 36*b* and 36*c* being followed. However, in all four instances, the average voltage on the two meshes 28 and 29 remains $V_2$ and therefore the focusing of the electron beams in the space 24 between the meshes 22 and 23** is unaffected by the biasing of the focus meshes at different voltages.

In another technique of biasing the mesh structure of FIG. 4, the extraction electrode is biased with a voltage $V_3$ or $V_4$. When the extraction voltage $V_3$ is used, the electron beam 37 follows the path **37*a* and when the extraction voltage $V_4$ is used, the electron beam 37 follows the path 37*b*. The electron beams along the paths 37*a* and 37*b* are further divided along the paths 37*c*, 37*d* and 37*e*, 37*f*, respectively, by biasing the focus meshes 28 and 29 with the biasing voltages $V_2 \pm \Delta V_{f3}$. Thus, when the extraction voltage on extraction electrode 30 is $V_3$, either the path 37*c* or 37*d* is followed, and when $V_4$ is used, either the path 37*e* or 37*f*** is followed.

I claim:

1. In a flat panel display device having a display area where the sequential impingement of electrons along successive lines effects a visual display, and including a beam guide structure having electron beam propagation means for propagating at least one electron beam along paths substantially parallel to said display area, and having means for focusing electron beams traveling toward said display area, said display device also including extraction means arranged substantially perpendicular to said beam propagation means and substantially parallel to said successive lines for repelling said at least one electron beam from said beam propagation means toward said display area for scanning along said lines, an improvement wherein said means for focusing includes a plurality of apertured focus meshes arranged in a spaced and parallel relationship with respect to one another and with respect to said electron beam propagation means, each of said focus meshes including apertures arranged in at least one column along the length of said meshes and in the direction of electron beam propagation, the apertures in the respective focus meshes being off set in the direction of electron beam propagation, said extraction means including a plurality of extraction electrodes extending along one dimension of said display area and perpendicular to said at least one column.

2. The device of claim 1 wherein said offset is substantially equal to one half the dimension of said aperture in the direction of electron beam propagation.

3. The device of claim 2 wherein each of said focus meshes includes one column of apertures.

4. The device of claim 2 wherein each of said focus meshes includes three columns of apertures and the apertures in each of said meshes are arranged in rows transversely of said focus meshes.

5. The device of claim 3 or 4 wherein there are two of said focus meshes.

6. The device of claim 5 wherein one of said focus meshes is biased with one of the four voltages $V_2 \pm \Delta V_{f1} \pm \Delta V_{f2}$ and the other of said focus meshes is biased with another of the four voltages $V_2 \pm \Delta V_{f1} \pm \Delta V_{f2}$, the two voltages being selected such that the average voltage on the two meshes is $V_2$, and wherein one of said extraction electrodes is biased with a voltage $V_1$ to repel said electron beams from said propagation means, so that said electron beams impinges said display area on one of four of said lines.

7. The device of claim 5 wherein one of said focus meshes is biased with one of the voltages $V_2 \pm \Delta V_{f1}$ and the other one of said focus meshes is biased with the other of said voltages $V_1 \pm \Delta V_{f1}$ and wherein said electron beams are sometimes repelled from said propagation means by biasing one of said extraction electrodes with a voltage $V_3$ and sometimes are repelled from said propagation means by biasing one of said extraction electrodes with a voltage $V_4$ so that repelled electron beams impinge said display area on one of four of said lines.

* * * * *